US005501497A

United States Patent [19]

Holloway

[11] Patent Number: 5,501,497

[45] Date of Patent: Mar. 26, 1996

[54] ADJUSTABLE DRUM HANDLING CARRIER

[75] Inventor: Bradley Holloway, Angola, Ind.

[73] Assignee: Vestil Manufacturing Company, Angola, Ind.

[21] Appl. No.: 214,842

[22] Filed: Mar. 16, 1994

[51] Int. Cl.[6] ..... B66C 1/10

[52] U.S. Cl. ..... 294/86.4; 294/67.22; 294/67.3; 294/119.2; 414/444; 414/622

[58] Field of Search ..... 294/2–4, 15, 16, 294/31.2, 32, 34, 67.1, 67.22, 67.3, 67.33, 67.5, 68.26, 68.27, 68.3, 86.4, 86.41, 90, 103.1, 119.1, 119.2; 248/133, 139, 143; 414/419, 425, 444, 448, 449, 451, 607, 608, 618–622, 731, 743

[56] References Cited

U.S. PATENT DOCUMENTS

| | | | |
|---|---|---|---|
| 1,250,602 | 12/1917 | Lobdell | 294/67.22 |
| 1,542,713 | 6/1925 | Olson | 248/143 |
| 1,790,319 | 1/1931 | Rall et al. | 248/143 X |
| 2,399,360 | 4/1946 | Lacey | 294/67.5 X |
| 2,789,858 | 4/1957 | Kughler | 294/119.1 X |
| 2,827,184 | 3/1958 | Mueller | 414/607 X |
| 2,879,102 | 3/1959 | Kughler | 294/90 X |
| 3,052,441 | 9/1962 | Fleischman | 294/68.27 X |
| 3,112,835 | 12/1963 | Gierhart | 294/68.26 X |
| 3,310,336 | 3/1967 | Chenault | 294/90 |
| 3,785,692 | 1/1974 | Ericson | 294/90 |
| 3,794,371 | 2/1974 | Arbouw | 294/90 |
| 4,103,812 | 8/1978 | Steiner | 294/34 X |
| 4,182,531 | 1/1980 | de Szegheo | 294/90 |
| 4,213,647 | 7/1980 | Thurmond, Jr. | 294/90 |
| 4,619,475 | 10/1986 | Sylvest, II | 294/90 |

FOREIGN PATENT DOCUMENTS

| | | | |
|---|---|---|---|
| 1194127 | 11/1957 | France | 248/143 |
| 1089043 | 4/1984 | U.S.S.R. . | |

OTHER PUBLICATIONS 4 page Bulletin—Tab 7 Drum Master Drum Handling Equipment for Every Need—Bulletin—Drum 992 Published by Vestil Manufacturing Company, Angola, Indiana.

*Primary Examiner*—Johnny D. Cherry
*Attorney, Agent, or Firm*—Gifford, Krass, Groh, Sprinkle, Patmore, Anderson & Citkowski

[57] ABSTRACT

An adjustable drum handling carrier particularly adapted for use in handling fiber drums includes an upright tube with telescoping top and bottom bracket tubes. The upright tube is attached to a midpoint of a cradle. The side wall of the drum is peripherally engaged by the cradle, and the ends of the drum are engaged by the top and bottom brackets.

4 Claims, 1 Drawing Sheet

ADJUSTABLE DRUM HANDLING CARRIER

BACKGROUND OF THE INVENTION

1. Field of the Invention

This invention relates to drum carriers, and, more particularly, this invention relates to an adjustable cradle type drum carrier.

2. State of the Prior Art

There is a wide variety of carriers available, adapted to lift and transport drums and barrels. Typically, the carrier will have an upright member with an appendage at each end to engage the drum. One of the appendages may be adjustable so as to grasp a bead at the top of the drum.

A popular drum carrier produced and marketed by Vestil Manufacturing Company of Angola, Indiana eliminates the standard upright extending member by utilizing an arcuate cradle which peripherally engages the drum, the drum being retained against the cradle by an adjustable chain lock. Both the upright member type and cradle type carrier satisfactorily handle metal drums primarily because the metal drum has inherent strength and stability. The cradle type carrier provides more versatility in that it can be used with other equipment such as drum rotators with no danger of drum slippage.

SUMMARY OF THE INVENTION

It is difficult to handle fiber drums with available carriers of the upright member type and the cradle type. The difficulty lies in the inherent weakness of the fiber drum itself causing undesirable flexure or collapsing of the drum side wall. This is particularly true when the carrier must be moved to rotate the drum from its vertical axis, as, for example in a pouring operation. The present .invention is directed to an adjustable drum handling carrier that can be used with fiber drums overcoming these prior art problems.

The present invention embraces the best features of an upright member carrier with a saddle type carrier, and, in an important embodiment, the invention provides an adjustable attachment to an existing cradle type carrier.

The adjustable drum handling carrier of the present invention includes an assembly tube with means for removably attaching the assembly tube to a midpoint of the cradle. A top and bottom bracket tube is telescopingly received within the assembly tube, and each bracket tube has a drum engaging bracket at its free end. Means are provided for releasably locking the top and bottom bracket tubes in the assembly tube at positions to secure a drum between the drum engaging brackets In the preferred form of the invention snap button fasteners are used to releasably lock the top and bottom bracket tubes within the assembly tube.

BRIEF DESCRIPTION OF THE DRAWING

The advantages of the present invention will be more apparent from the following detailed description when considered in connection with the accompanying drawing wherein.

DETAILED DESCRIPTION OF THE INVENTION

Figure 1:
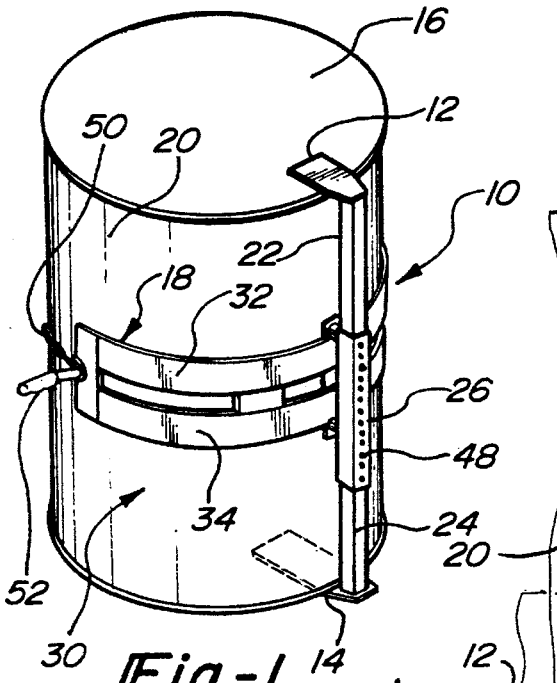
FIG. 1 is a perspective view of the adjustable drum handling carrier of this invention as it has been adjusted and clamped to a drum for use.
Figure 2:
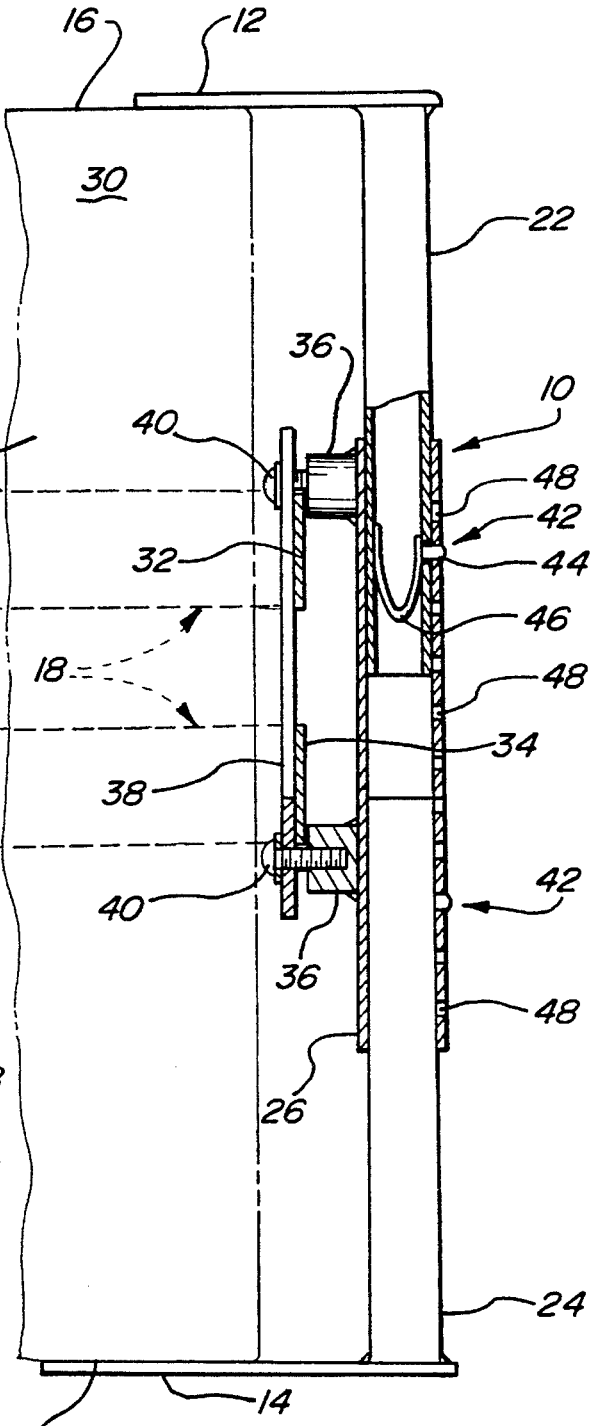
FIG. 2 is a vertical elevational view in partial section showing the assembly tube attachment to the cradle and the snap button locking of the top and bottom bracket tubes to the assembly tube as the cradle and the drum engaging brackets are in position grasping the drum being carried.

Referring to FIGS. 1 and 2, the adjustable drum handling carrier 10 of this invention is shown with its top and bottom drum engaging brackets 12 and 14 in engagement with the drum ends 16 and the cradle 18 in engagement with the periphery of the drum side wall 20.

Figure 3:
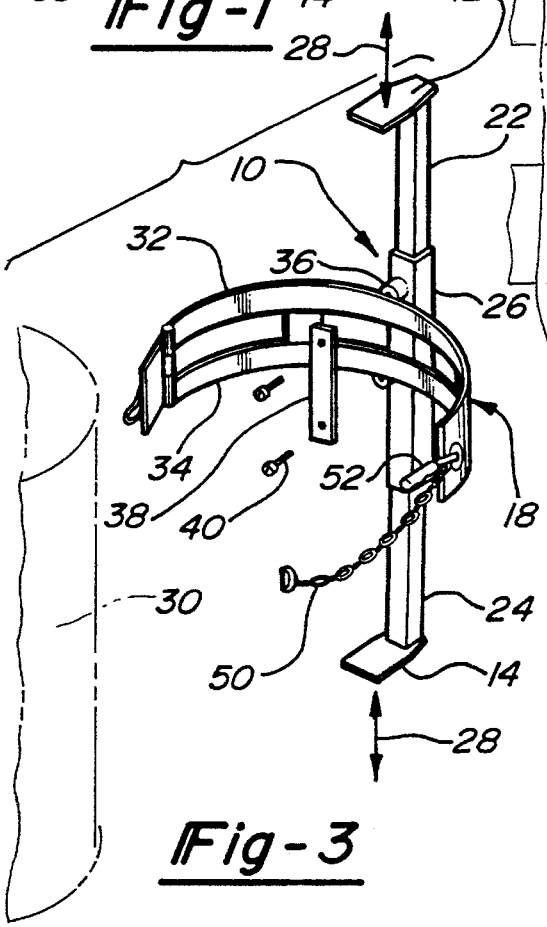
FIG. 3 is an exploded perspective view of the carrier of this invention disclosing its application to a drum shown in phantom.

Top and bottom brackets 12 and 14 are welded to top and bottom bracket tubes 22 and 24 which are telescopingly received in assembly tube 26 for vertical adjustment as shown by arrows 28 in FIG. 3 to accommodate drums 30 of various heights.

The assembly tube 26 of the adjustable drum handling carrier 10 is removably attached to a midpoint of the arcuate cradle 18 by trapping upper and lower cradle straps 32 and 34 between threaded bosses 36 welded to the assembly tube and the attachment bar 38. The attachment bar 38 is secured to the bosses 36 by bolts 40.

For rapid adjustment and positive locking, snap buttons 42 are used to adjustably secure the top and bottom bracket tubes 22 and 24 to the assembly tube 26. As is well known in the art, the snap button 42 has a projection or button portion 44 which is held in an aperture through the inner top and bottom bracket tubes 22 and 24 by a spring 46 to project through a selected one of a series of apertures 48 in the outer assembly tube 26. Such a fastener 42 known as a Valco snap button fastener, can be purchased from Valco/Valley Tool and Die, Inc. of North Royalton, Ohio. Typically, the snap buttons are produced in a variety of models such as a single, dual or latch type button. Movement of the brackets 22 and 24 in the assembly tube 26 is obtained by depressing the button 44 and moving the tubes 22 and 24 so that the button protrudes through a selected one of the apertures 48 in the assembly tube 26.

Retention of the drum 30 against the upper and lower or top and bottom drum engaging brackets 12 and 14 in peripheral contact with the upper and lower straps 32 and 34 of cradle 18 is maintained by the chain lock 50 tightened by lever mechanism 52 as in a conventional cradle carrier.

I claim:

1. An adjustable drum handling carrier comprising:

an arcuate cradle for peripherally engaging said drum;

an upright assembly tube extending parallel to an axis of said drum and removably attached to a midpoint of said cradle by a strap and bolts received in spaced threaded bosses on said assembly tube; and a top and a bottom bracket tube each having an end adjustably telescoped within said assembly tube and each having a drum engaging bracket at a free end.

2. The carrier according to claim 1 wherein said top and bottom bracket tubes are adjustably locked to said assembly tube with snap buttons.

3. An adjustable drum handling carrier comprising:

an arcuate cradle for peripherally engaging said drum;

an assembly tube;

a strap and threaded connectors attaching said assembly tube to a midpoint of said cradle;

a top and a bottom bracket tube each having an end telescopingly received within said assembly tube and each having a drum engaging bracket at a free end; and snap button fasteners releasably locking said top and bottom bracket tubes in said assembly tube at positions to secure a drum between said drum engaging brackets.

4. An adjustable attachment for a drum handling carrier having an arcuate cradle for peripherally engaging said drum, said attachment comprising:

an assembly tube;

a strap and threaded connectors for removably attaching said assembly tube to a midpoint of said cradle;

a top and a bottom bracket tube each having an end telescopingly received within said assembly tube and each having a drum engaging bracket at a free end; and snap button fasteners releasably locking said top and bottom bracket tubes in said assembly tube at positions to secure a drum between said drum engaging brackets.

* * * * *